US007023345B2

(12) United States Patent
Lian et al.

(10) Patent No.: US 7,023,345 B2
(45) Date of Patent: Apr. 4, 2006

(54) ENHANCING MAGNETO-IMPEDANCE MODULATION USING MAGNETOMECHANICAL RESONANCE

(75) Inventors: Ming-Ren Lian, Boca Raton, FL (US); Hubert A. Patterson, Boca Raton, FL (US); Nen-Chin Liu, Wellington, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 127 days.

(21) Appl. No.: 10/837,822

(22) Filed: May 3, 2004

(65) Prior Publication Data

US 2005/0242955 A1 Nov. 3, 2005

(51) Int. Cl.
*G08B 13/14* (2006.01)

(52) U.S. Cl. ..... 340/572.6; 340/572.4; 340/572.5

(58) Field of Classification Search ..... 340/572.6, 340/572.1, 572.3, 572.4, 572.7, 572.8, 551, 340/572.5
See application file for complete search history.

(56) References Cited

U.S. PATENT DOCUMENTS

| | | | | |
|---|---|---|---|---|
| 4,510,489 | A | 4/1985 | Anderson, III et al. | |
| 5,999,098 | A * | 12/1999 | Lian et al. | 340/572.6 |
| 6,121,879 | A * | 9/2000 | Lian et al. | 340/572.3 |
| 6,204,766 | B1 * | 3/2001 | Crossfield et al. | 340/572.6 |
| 6,225,905 | B1 | 5/2001 | Tyren et al. | |
| 6,307,474 | B1 | 10/2001 | Lian et al. | |
| 6,356,197 | B1 * | 3/2002 | Patterson et al. | 340/572.1 |
| 6,426,700 | B1 * | 7/2002 | Lian et al. | 340/572.6 |
| 6,476,720 | B1 * | 11/2002 | Andersen et al. | 340/572.1 |
| 6,489,891 | B1 * | 12/2002 | Ho et al. | 340/572.3 |
| 6,720,877 | B1 * | 4/2004 | Lian et al. | 340/572.8 |

* cited by examiner

*Primary Examiner*—John Tweel, Jr.

(57) ABSTRACT

A method and apparatus to enhance magnetoimpedance effect using magnetomechanical resonance are described.

26 Claims, 11 Drawing Sheets

ENHANCING MAGNETO-IMPEDANCE MODULATION USING MAGNETOMECHANICAL RESONANCE

BACKGROUND

An Electronic Article Surveillance (EAS) system is designed to prevent unauthorized removal of an item from a controlled area. A typical EAS system may comprise a monitoring system and one or more security tags. The monitoring system may create a surveillance zone at an access point for the controlled area. A security tag may be fastened to an item, such as an article of clothing. If the tagged item enters the surveillance zone, an alarm may be triggered indicating unauthorized removal of the tagged item from the controlled area.

The area comprising the surveillance zone may be limited due to a number of problems. For example, the security tag may produce a relatively weak signal that becomes difficult to detect as the distance between the security tag and detection system increases. The receiver may also have difficulty in discriminating between the signal from the security tag and other signals in the surveillance zone. Consequently, there may be need for improvements in such techniques in a device or network.

BRIEF DESCRIPTION OF THE DRAWINGS

The subject matter regarded as the embodiments is particularly pointed out and distinctly claimed in the concluding portion of the specification. The embodiments, however, both as to organization and method of operation, together with objects, features, and advantages thereof, may best be understood by reference to the following detailed description when read with the accompanying drawings in which:

DETAILED DESCRIPTION

The embodiments may be directed to an EAS system in general. More particularly, the embodiments may be directed to a security tag for use with an EAS system. The security tag may include a magnetoimpedance marker configured to generate a modulated reply signal that is enhanced using magnetomechanical resonance. As a result, the security tag may be detectable at further distances relative to conventional markers. In addition, the magnetomechanical resonance may also cause the modulated reply signal to have a unique signature, thereby improving detection accuracy and reducing false alarms.

Numerous specific details may be set forth herein to provide a thorough understanding of the embodiments of the invention. It will be understood by those skilled in the art, however, that the embodiments of the invention may be practiced without these specific details. In other instances, well-known methods, procedures, components and circuits have not been described in detail so as not to obscure the embodiments of the invention. It can be appreciated that the specific structural and functional details disclosed herein may be representative and do not necessarily limit the scope of the invention.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 1:
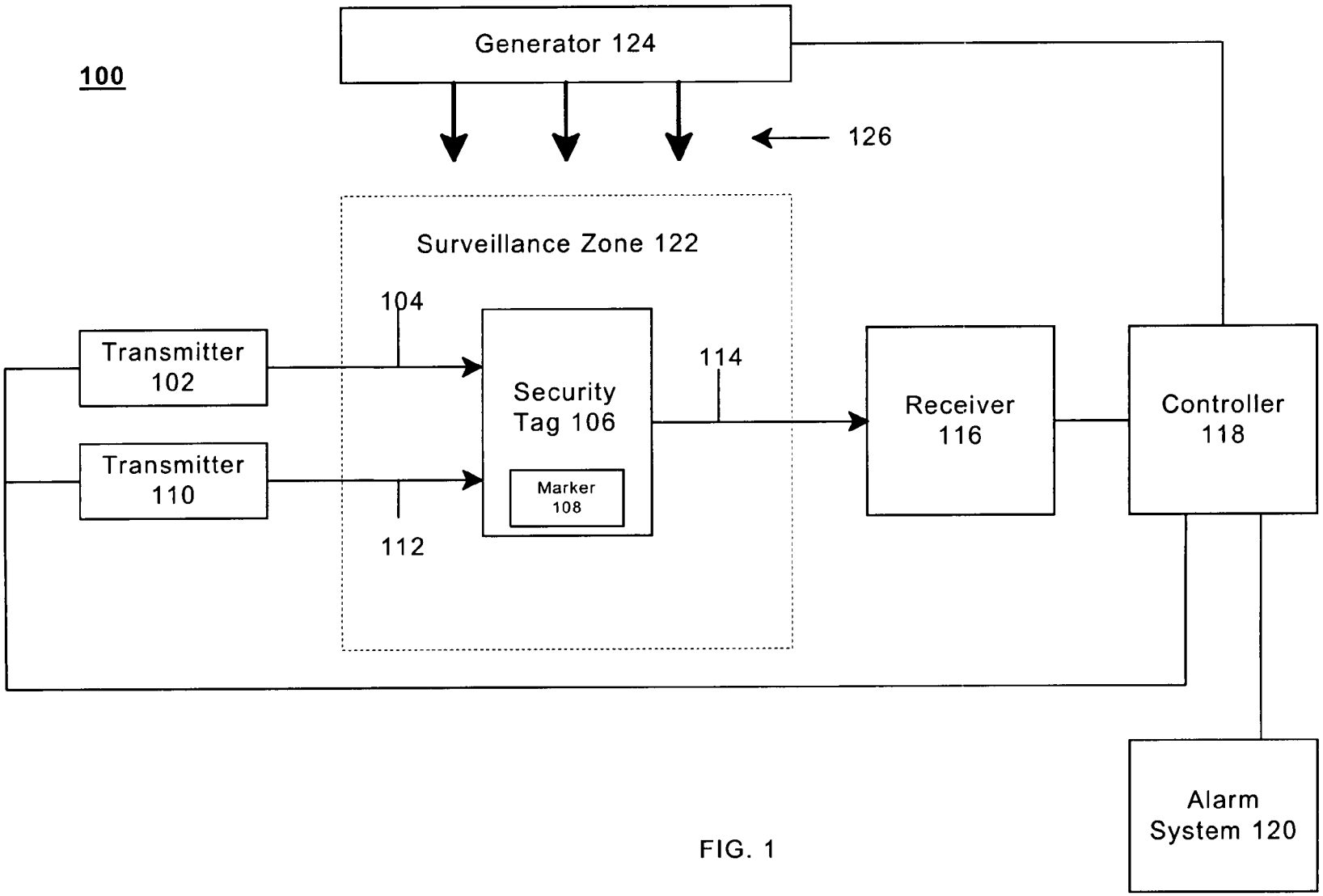
FIG. 1 illustrates a first system in accordance with one embodiment.

Referring now in detail to the drawings wherein like parts are designated by like reference numerals throughout, there is illustrated in FIG. 1 a system suitable for practicing one embodiment. FIG. 1 illustrates an EAS system 100. Although FIG. 1 describes a particular EAS system by way of example, it may be appreciated that the embodiments may operate with any EAS system as modified using the principles discussed herein.

In one embodiment, EAS system 100 may comprise monitoring equipment configured to monitor a surveillance zone, such as surveillance zone 122. The monitoring equipment may be configured to detect the presence of a security tag within the surveillance zone using both magnetoimpedance and/or magnetomechanical detection techniques. In one embodiment, EAS system 100 may include a transmitter 102, transmitter 110, a security tag 106, a receiver 116, a controller 118, an alarm system 120, and a magnetic field generator 124. Although FIG. 1 shows a limited number of elements, it can be appreciated that any number of additional elements may be used in system 100. The embodiments are not limited in this context.

In one embodiment, EAS system 100 may comprise transmitter 102. Transmitter 102 may comprise any transmitter system configured to transmit high frequency signals, such as microwave signals. The microwave signals may include a 2.45 GigaHertz (GHz) microwave signal or a 915 MegaHertz (MHz) microwave signal, for example, although the embodiments are not limited in this context. Transmitter 102 may comprise a transmitter antenna operatively coupled to an output stage, which in turn is connected to a controller, such as controller 118. The output stage may comprise various conventional driving and amplifying circuits, including a circuit to generate a high frequency electric current. When the high frequency electric current is supplied to the transmitter antenna, the transmitter antenna may generate high frequency electromagnetic field signals 104 around the transmitter antenna. The field may propagate into surveillance 122. Signals 104 may comprise a first excitation signal to excite a first property of marker 108 of security tag 106. The first property may comprise, for example, a magnetoimpedance property of marker 108.

In one embodiment, EAS system 100 may comprise transmitter 110. Transmitter 110 may comprise any transmitter system configured to transmit low frequency signals. The low frequency signals for a given implementation may be selected in accordance with the material and dimensions used for marker 108. More particularly, transmitter 110 may transmit low frequency signals appropriate to cause marker 108 to resonate at a predetermined resonant frequency, for example. Transmitter 110 may comprise a transmitter antenna operatively coupled to an output stage, which in turn is connected to a controller, such as controller 118. The output stage may comprise various conventional driving and amplifying circuits, including a circuit to generate a low frequency electric current. When the low frequency electric current is supplied to the transmitter antenna, the transmitter antenna may generate low frequency electromagnetic field signals 112 around the transmitter antenna. The field may propagate into surveillance 122. Signals 112 may comprise a second excitation signal to excite a second property of marker 108 of security tag 106. The second property may comprise, for example, a magnetomechanical resonance property of marker 108. Second excitation signal 112 may be of any frequency that is appropriately tuned to cause marker 108 to resonate at the predetermined resonant frequency.

In one embodiment, EAS system 100 may comprise security tag 106. Security tag 106 may be designed to attach to an item to be monitored. Examples of tagged items may include an article of clothing, a Digital Video Disc (DVD) or Compact Disc (CD) jewel case, a movie rental container, packaging material, and so forth. The embodiments are not limited in this context.

In one embodiment, security tag 106 may comprise a marker 108 disposed within a security tag body or housing. The security tag body may be soft or hard structure designed to encase marker 108. Marker 108 may comprise, for example, a combination magnetoimpedance marker and a magnetomechanical resonance marker. Marker 108 may be composed of magnetostrictive material configured to resonate at a predetermined frequency. When marker 108 receives the first excitation signal modulated by a low frequency alternating magnetic field, the marker may generate modulated reply signal 114. When marker 108 receives the second excitation signal having approximately the same frequency as the resonant frequency of marker 108, marker 108 may begin to resonate. Modulated reply signal 114 may realize an increase in gain when the magnetostrictive material resonates at the predetermined frequency. Security tag 106 may be discussed in more detail with reference to FIGS. 2–10.

In one embodiment, EAS system 100 may comprise a receiver 116. Receiver 116 may comprise any receiver system configured to receive high frequency electromagnetic field signals 104 from transmitter 102, as well as modulated reply signal 114 from marker 108. For example, receiver 116 may comprise conventional amplifying and signal-processing circuits, such as band pass filters, mixers and amplifier circuits. In addition, receiver 116 may comprise an output stage connected to controller 118, which is configured to receive and process modulated reply signal 114. The processed signals may then be forwarded to controller 118 to perform detection operations.

In one embodiment, EAS system 100 may comprise generator 124. Generator 124 may comprise a coil arrangement to generate a low frequency alternating current (AC) magnetic field 126. The coil arrangement may be configured to generate magnetic field 126 with sufficient strength to cover the same area as surveillance zone 122. Modulation signals 126 may comprise modulation signals to modulate a reply signal from marker 108 to form modulated reply signal 114. Modulated reply signal 114 may be received by receiver 116, and used by controller 118 to detect the presence of security tag 106 within surveillance zone 122. The frequency of modulation signals 126 may vary depending on a given implementation, such as 1–10 Kilo Hertz (KHz), for example. The embodiments are not limited in this context.

In addition to modulation signals 126, generator 124 may also be configured to perform the function of transmitter 110. In one embodiment, for example, generator 124 may be configured to generate the low frequency signals (i.e., signals 112) comprising the second excitation signal to excite the magnetomechanical resonance property of marker 108 of security tag 106. This configuration may obviate the need for transmitter 110. The embodiments are not limited in this context.

In one embodiment, EAS system 100 may comprise controller 118. Controller 118 may comprise a processing and control system configured to manage various operations for EAS system 100. For example, controller 118 may send synchronization signals to transmitter 102. Since marker 108 may be interrogated and detected at a similar frequency used by transmitter 102, the transmitted signals 104 may interfere with the detection of marker 108. Therefore, EAS system 100 may be implemented as a "pulsed system," wherein transmitter 102 and receiver 116 are alternatively turned off and on to reduce interference at receiver 116. The embodiments are not limited in this context.

In one embodiment, controller 118 may receive processed signals from receiver 116. Controller 118 may use the processed signals to determine whether security tag 106 is within surveillance zone 122. For example, modulated reply signal 114 may include a number of detectable sidebands around the center frequency. At least one sideband may be used to determine if security tag 106 is within surveillance zone 122. If security tag 106 is detected within surveillance zone 122, controller 118 may generate a detect signal and forward the signal to alarm system 120.

In one embodiment, EAS system 100 may comprise alarm system 120. Alarm system 120 may comprise any type of alarm system to provide an alarm in response to an alarm signal. The alarm signal may be received from any number of EAS components, such as controller 118. Alarm system 120 may comprise a user interface to program conditions or rules for triggering an alarm. Examples of the alarm may comprise an audible alarm such as a siren or bell, a visual alarm such as flashing lights, or a silent alarm. A silent alarm may comprise, for example, an inaudible alarm such as a message to a monitoring system for a security company. The message may be sent via a computer network, a telephone network, a paging network, and so forth. The embodiments are not limited in this context.

In general operation, transmitter 102 may communicate excitation signals 104 and 112 into surveillance zone 122. Generator 124 may send modulation signals 126 into surveillance zone 122. Marker 108 may receive excitation signal 104, and transmit a reply signal at the same frequency as the received excitation signal. The reply signal from marker 108 may be modulated by modulation signal 126 to form modulated reply signal 114. Marker 108 may also receive excitation signal 112. Excitation signal 112 may have the same frequency as the resonant frequency for marker 108, thereby causing marker 108 to resonate. The resonance may cause marker 108 to realize an increase in gain in modulated reply signal 114. Receiver 116 may receive modulated reply signal 114, process the signal into electrical current, and forward the processed signal to controller 118. Controller 118 may receive and analyze the signal from receiver 116 to determine whether security tag 106 is within surveillance zone 122.

In one embodiment, transmitter 110, receiver 116 and controller 118 may be elements from a conventional EAS magnetomechanical system, such as an Ultra•Max® system made by Sensormatic® Corporation, for example. In this embodiment, security tag 106 may also operate in a conventional EAS magnetomechanical system, thereby illustrating the robust nature of security tag 106. The embodiments are not limited in this context.

Figure 2:
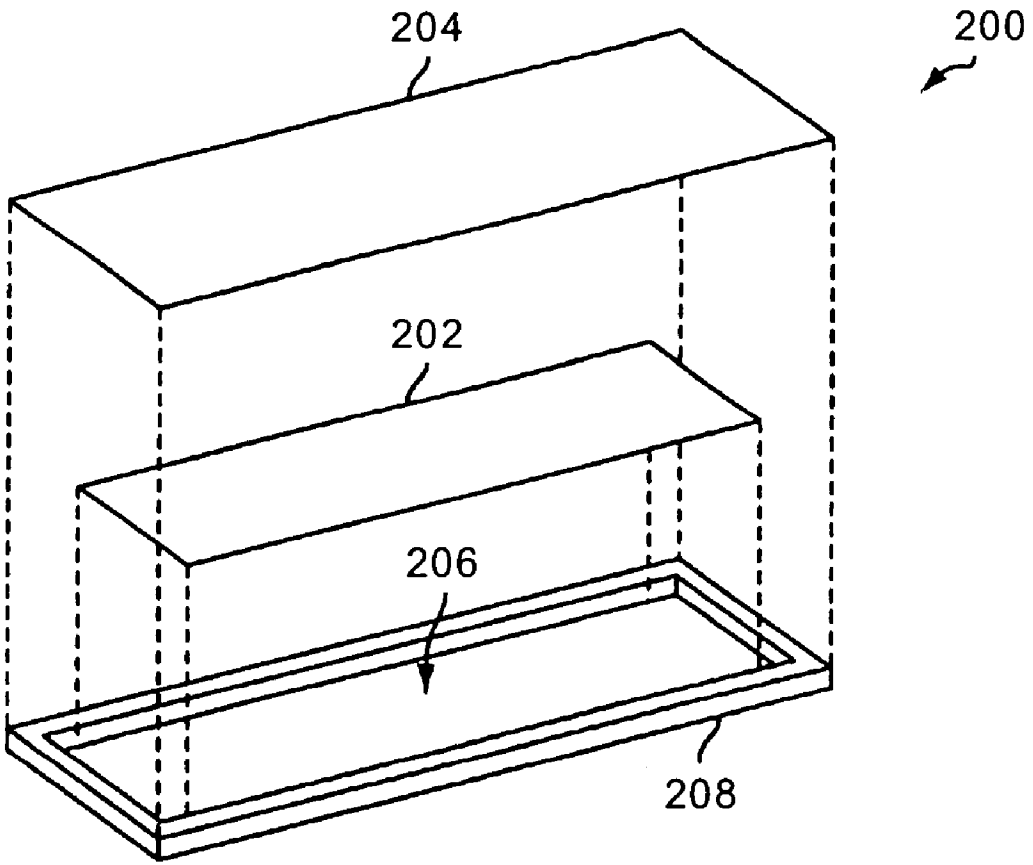
FIG. 2 illustrates a marker in accordance with one embodiment.

FIG. 2 illustrates a marker in accordance with one embodiment. FIG. 2 may illustrate a marker 200. Marker 200 may be representative of, for example, marker 108 of security tag 106. Marker 200 may be configured to operate with both a magnetoimpedance system and a magnetomechanical system. In one embodiment, marker 200 may comprise a resonator 202, biasing element 204, and marker body 208. Marker body 208 may further comprise cavity 206. Although FIG. 2 shows a limited number of elements, it can be appreciated that any number of additional elements may be used in marker 200. The embodiments are not limited in this context.

Marker 200 may provide several advantages over conventional markers. For example, one problem associated with conventional magnetoimpedance systems is the detection range for such systems. Normally, the propagation of microwave energy is efficient. The voltage decays with the inverse of the distance, allowing long range detection. The presence detection relies on the detection of a sideband in the modulated reply signal, whose magnitude is in proportion with the strength of the low frequency AC magnetic field. For non-linearity in magnetism to occur, however, the low frequency magnetic field has to be of sufficient strength. As a result, the low frequency magnetic field becomes a limiting factor in increasing the overall detection distance for the conventional magnetoimpedance system. In another example, deactivating conventional magnetoimpedance markers may be challenging. For deactivation, a substantial amount of hard/semihard magnetic material is required to be applied adjacent to the magnetoimpedance material. To deactivate, such a hard/semihard material is saturated to provide enough magnetic field to surpass the nonlinear properties of the magnetoimpedance material, so that the microwave energy does not mix with the low frequency magnetic field. It may prove difficult, however, to eliminate the non-linear magnetic effect totally, and a small sideband component may still remain after the deactivation operation.

Marker 108 may solve these and other problems by using the magnetomechanical resonance behavior to enhance the magnetoimpedance modulation for better detection and deactivation. The advantage of magnetomechanical resonance offers a unique opportunity of a signal enhancement through a high resonant efficiency (Q) mechanical resonance. Consequently, the EAS system has a potential for longer detection distance. Another advantage is that magnetomechanical resonance also offers a unique signature, which may help in reducing or eliminating the likelihood of false alarm detection.

In one embodiment, marker 108 may be configured to take advantage of the natural resonance of a magnetostrictive material to enhance the magnetoimpedance effect and the modulation of microwave energy for EAS application. A microwave system has a long effective detection distance, since its field strength decays in a 1/r relation. The low frequency magnetic field used to modulate the magnetic properties, however, drops off at a much faster rate having a $1/r^3$ relation. Therefore, the low frequency magnetic field strength becomes the limiting factor for extending the detection distance. Marker 108 may resolve this limitation by taking advantage of the magnetomechanical resonant behavior. With the combination of these two magnetic properties, the material responds much better to the low frequency resonant magnetic field than a non-resonant one. In addition, with a sharp resonant signature, false alarm is less likely.

In one embodiment, marker 200 may comprise a resonator 202, biasing element 204, and marker body 208. Resonator 202 may be formed of a magnetostrictive ferromagnetic material adapted to resonate mechanically at a predetermined resonance frequency when biased by a magnetic field. The frequency transmitted by transmitter 102 is preselected to approximate the resonant frequency of resonator 202. Biasing element 204 may be disposed adjacent to resonator 202. Biasing element 204 may comprise a relatively high coercive ferromagnetic element. When magnetized, biasing element 204 may magnetically bias resonator 202 thereby permitting resonator 202 to resonate at the predetermined resonant frequency. Resonator 202 may be placed into cavity 206 in marker body 208 to reduce or prevent interference with the mechanical resonance.

In one embodiment, the material for resonator 202 may be selected to have certain magnetoimpedance properties in addition to magnetomechanical properties. Resonator 202 may operate as a transceiver. Resonator 202 may receive the first excitation signal from transmitter 102, and re-radiates the high frequency energy back to receiver 116. Resonator 202 may be cut to the half wave dipole length of the radio frequency (RF) signal to improve transceiver efficiency. For presence detection, however, it is important to differentiate the microwave signal from the material scattering and the direct feed from transmitters 102/110 to receiver 116. To achieve such a purpose, low frequency AC magnetic field 126 is used to modulate the magnetic properties of the material for resonator 202. As a result, the antenna efficiency of the material is modulated and a sideband around the microwave carrier signal is created for EAS detection purposes.

Resonator 202 may be formed using material having both magnetoimpedance and magnetomechanical properties. The AC impedance of a conductor is governed by the skin depth δ, the distance where electromagnetic field is capable of penetrating into the conductor. Skin depth δ may be represented using the following equation:

$$\delta = \frac{1}{\sqrt{\pi \cdot f \cdot \mu \cdot \sigma}}$$

where f is the frequency of the electromagnetic field, and μ and σ represent the permeability and conductivity, respectively, of the conductive material. At high frequency, the skin depth can be smaller than the physical cross-section of the conductor. The conducting current is restricted to flow only in the outer surface of the conductor, resulting in a higher resistivity than that in a DC or low frequency condition. The higher the frequency, the shorter the skin depth δ, and the higher the AC impedance of the conductor becomes. The skin depth depends also on the conductivity and permeability of the conductive material. The impedance of a soft magnetic, metallic material is higher than a non-magnetic one, providing the same conditions for all other parameters such as f and σ. Furthermore, it is much easier to control the resistivity of a soft magnetic conductor using a magnetic field. At near zero magnetic field, the permeability of the magnetoimpedance material is relatively high, and so is its AC impedance. As the magnetic field increases, the magnetic material saturates and its permeability reduces to single digit. As a result, the skin depth increases with a reduction in the AC impedance. For example, an amorphous magnetic wire has resistivity (ρ) about 125 μΩ-cm, with a very high permeability of $\mu_r$~10,000. At 1 Giga Hertz (GHz), the skin depths of such a material at this frequency are 2 μm and 50 μm for high permeability and near saturation states, respectively. As a result, the effective conductive areas for a 100 μm wire are 630 and 7850 $\mu m^2$ for the soft and saturated magnetic states, respectively. The ratio of resistivity change due to such a magnetic saturation is therefore about 12 times. This is significantly larger than other effects, such as magnetic Hall effect, magnetoresistive effect, and so forth.

EAS system 100 may use this magnetoimpedance effect of marker 200 for detecting the presence of security tag 106 within surveillance zone 122. Marker 200 may comprise a magnetic material high in magnetoimpedance effect which is used to scatter the microwave signal from transmitter 102 onto receiver 116. In addition, low frequency AC magnetic field 126 is applied to the magnetic material of marker 108 to create a time variation of the material's permeability. The resistivity and microwave reflectivity of the material changes accordingly, resulting in a mixing of the microwave and low frequency signals. The mixing operation generates a sideband signal with a frequency of $f_0 \pm f_m$. This signature may be used to detect the presence of security tag 106 within surveillance zone 122.

The effective permeability of the magnetic material used to form marker 200 can be improved significantly if the material is driven at its natural resonant frequency. The frequency is determined by the dimension of the magnetic material, as well as its Young's modulus. If un-restricted, the resonant efficiency (Q) can be very high. For example, the Q of an active strip of an Ultra•Max product can be as high as 300 to 400 ranges. Therefore, the "bottleneck" situation of magnetoimpedance modulation can be overcome by taking advantage of such resonant behavior. The response of a magnetomechanical resonant material to the low frequency magnetic field becomes much more sensitive at resonance than that of a non-resonant one. This may result in a greater detection distance for EAS system 100.

The operation of system 100 and marker 200 may be better understood by way of example. Assume a resonator 202 comprises a 5.5 cm strip cut from a reel-to-reel, transverse field annealed, Allied 2605SC material. This material has a composition of $Fe_{81}B_{13.5}Si_{3.5}C_2$. With the annealing process, there is a transverse anisotropy of about 1.5 Oe. The 5.5 cm strip length is tuned for the effective dipole length of 2.45 GHz microwave frequency. Such a strip exhibits a significant magnetomechanical resonant behavior. The strip resonates when the driving electromagnetic frequency matches the strip's natural frequency.

Figure 3:
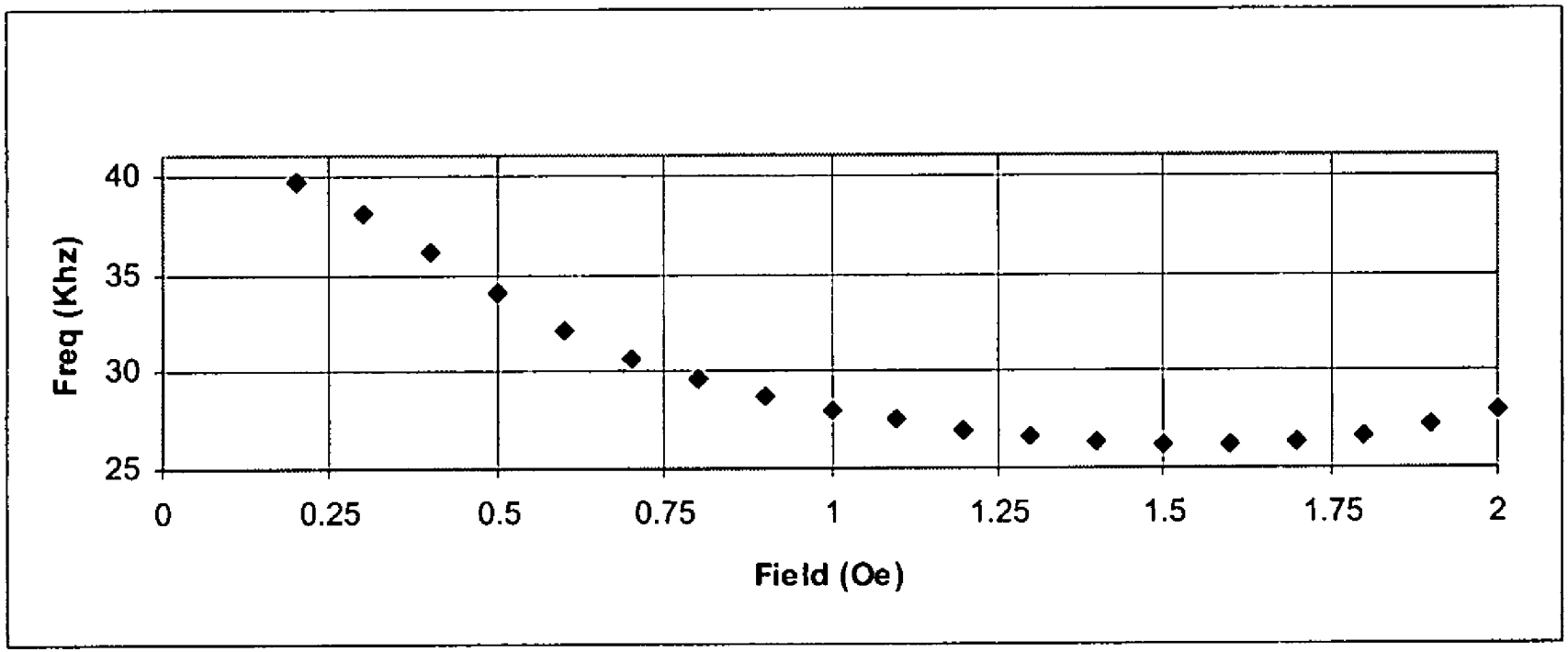
FIG. 3 comprises a graph illustrating a natural frequency of a marker as a function of a direct current (DC) magnetic field in accordance with one embodiment.

FIG. 3 comprises a graph illustrating a natural frequency of a marker as a function of a DC magnetic field. FIG. 3 illustrates that the natural frequency of resonator 202 varies significantly with a DC bias magnetic field. As can be seen in FIG. 3, resonator 202 resonates at approximately 40 kHz with near zero magnetic bias. As the bias increases, the resonant frequency decreases significantly, and gradually tapers off. Resonator 202 reaches its minimum at 26 kHz with a 1.5 Oe magnetic bias field. Beyond 1.5 Oe, the resonant frequency of resonator 202 quickly returns back to 40 kHz as the material saturates.

Figure 4:
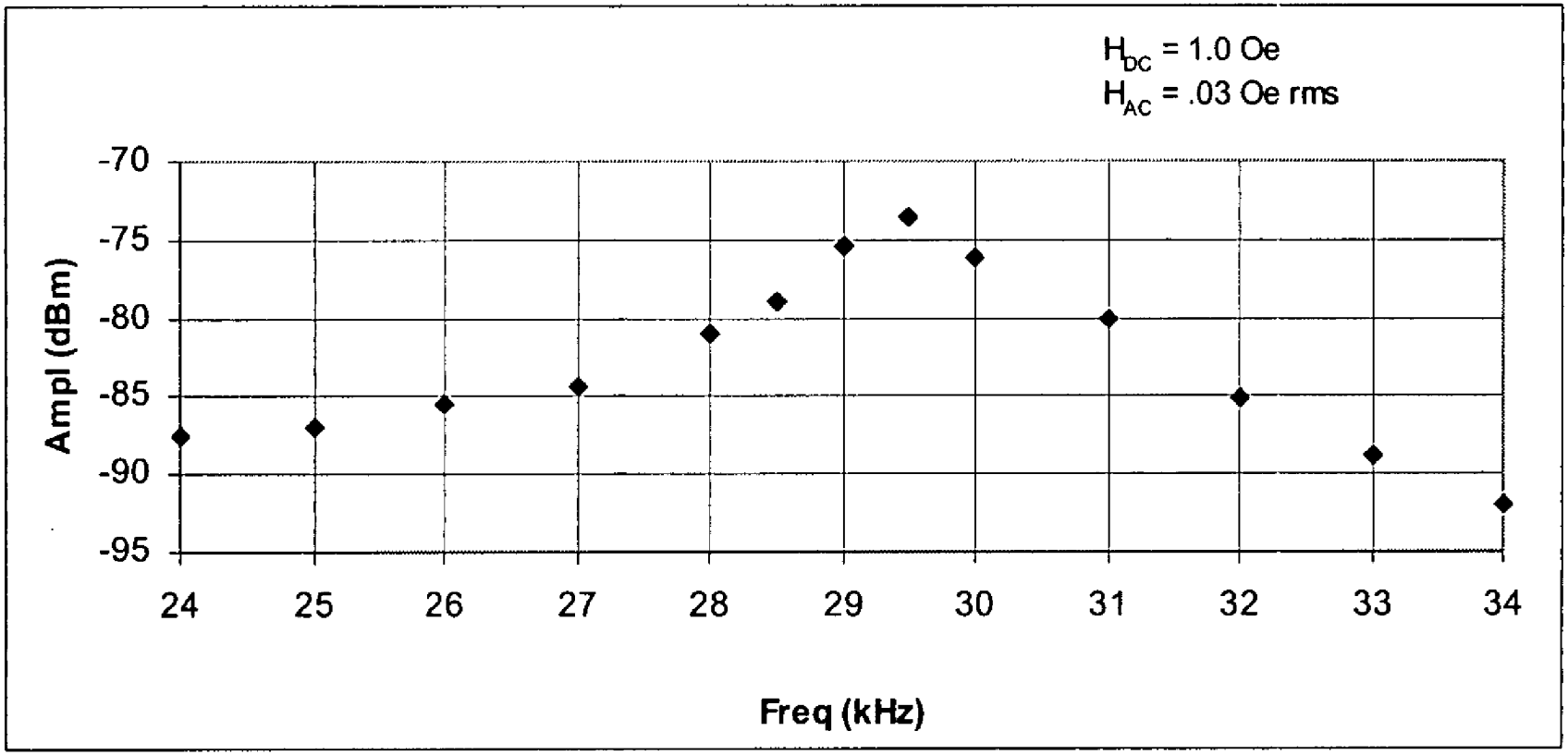
FIG. 4 comprises a graph illustrating changes in modulation amplitude due to magnetomechanical resonance of a marker in accordance with one embodiment.

FIG. 4 comprises a graph illustrating changes in modulation amplitude due to magnetomechanical resonance of a marker. Once the resonant frequency of resonator 202 has been identified, the effect of magnetoimpedance modulation of the microwave energy due to the magnetomechanical resonance may be measured. The measurements shown in FIG. 4 were derived by assuming that the microwave setting and power output level is maintained to be a constant, as well as the DC and low frequency magnetic field levels. As shown in FIG. 4, the modulation output may be measured as excitation frequency varied through the natural resonant frequency of resonator 202. As also shown in FIG. 4, there is a peak output which occurs at a frequency near 29.5 kHz, which is consistent with the resonant frequency of resonator 202. In this example, the gain due to such a resonant behavior is approximately 15 dbm.

FIGS. 5–10 may be used to illustrate a second example of a material suitable for use with marker 200. Assume in this example that resonator 202 comprises a material having a composition of $Fe_{40}Co_{40}B_{18}Si_2$. The material may be approximately 55 mm long and 6 mm wide. The sample was annealed at 410 C for 30 seconds in a saturation magnetic field across a width of said material.

Figure 5:
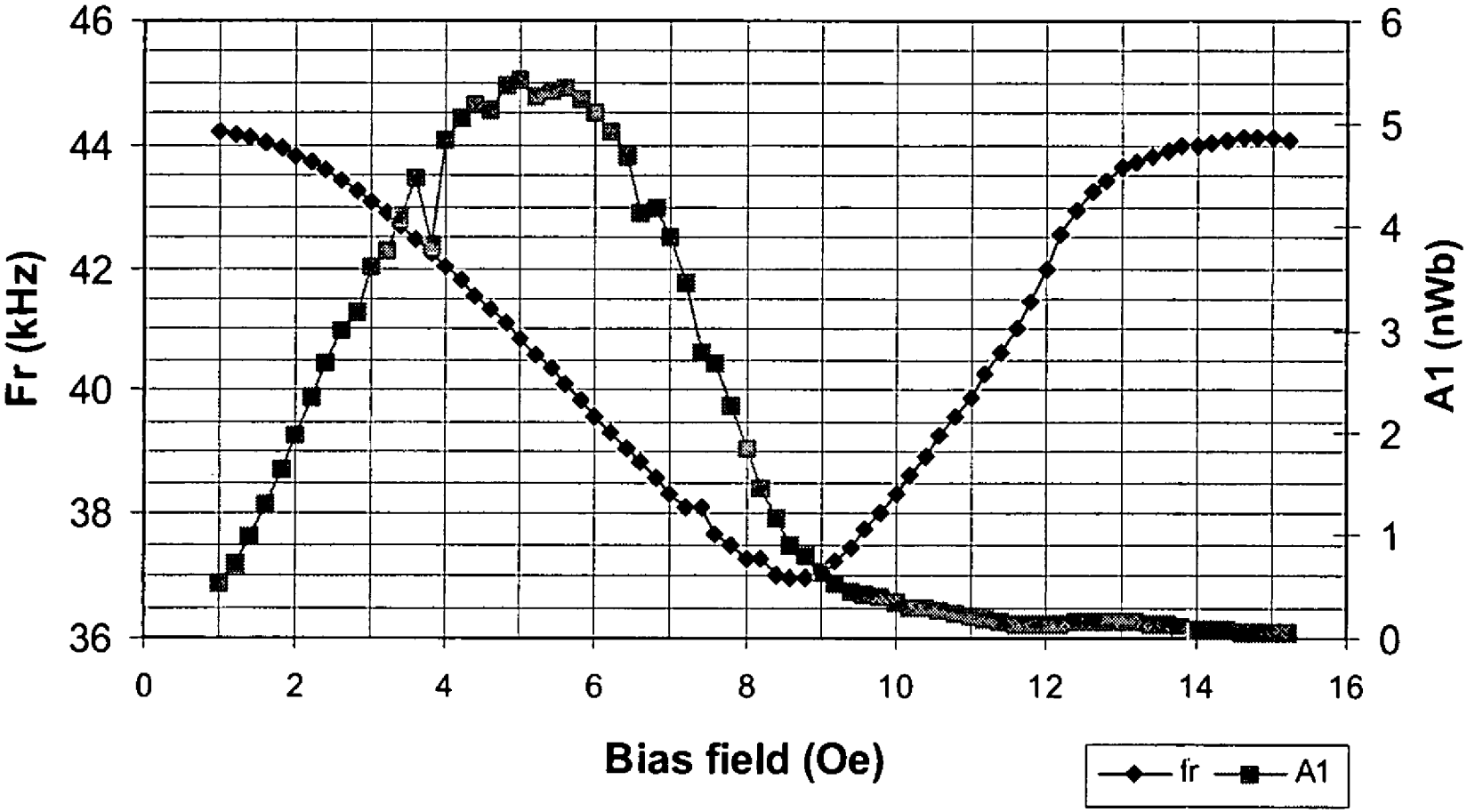
FIG. 5 comprises a graph illustrating resonance frequency and mechanical ring-down amplitude versus bias field strength in accordance with one embodiment.
Figure 6:
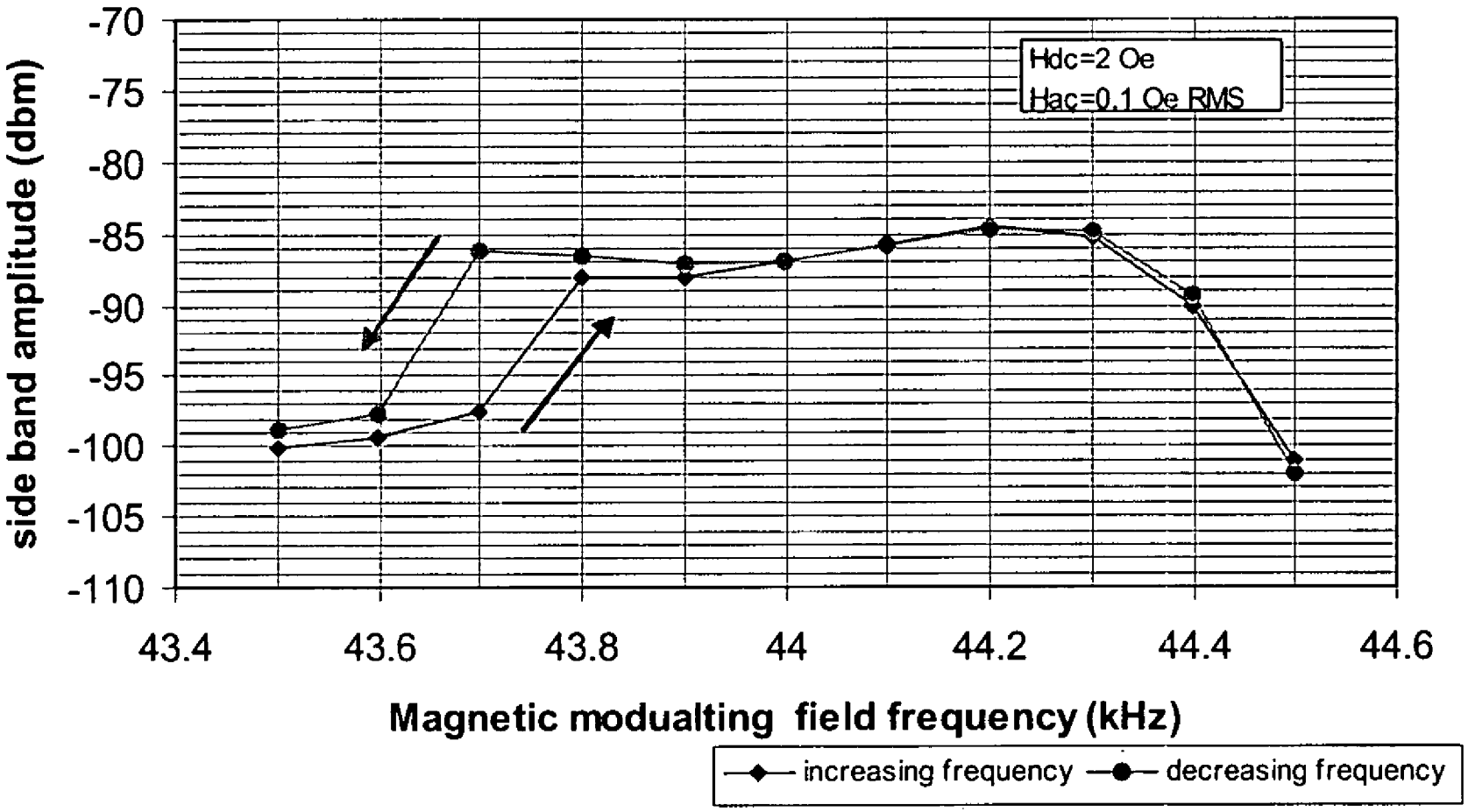
FIG. 6 comprises a graph illustrating sideband amplitude versus magnetic modulating field frequency at 2 Oersteds (Oe) in accordance with one embodiment.
Figure 7:
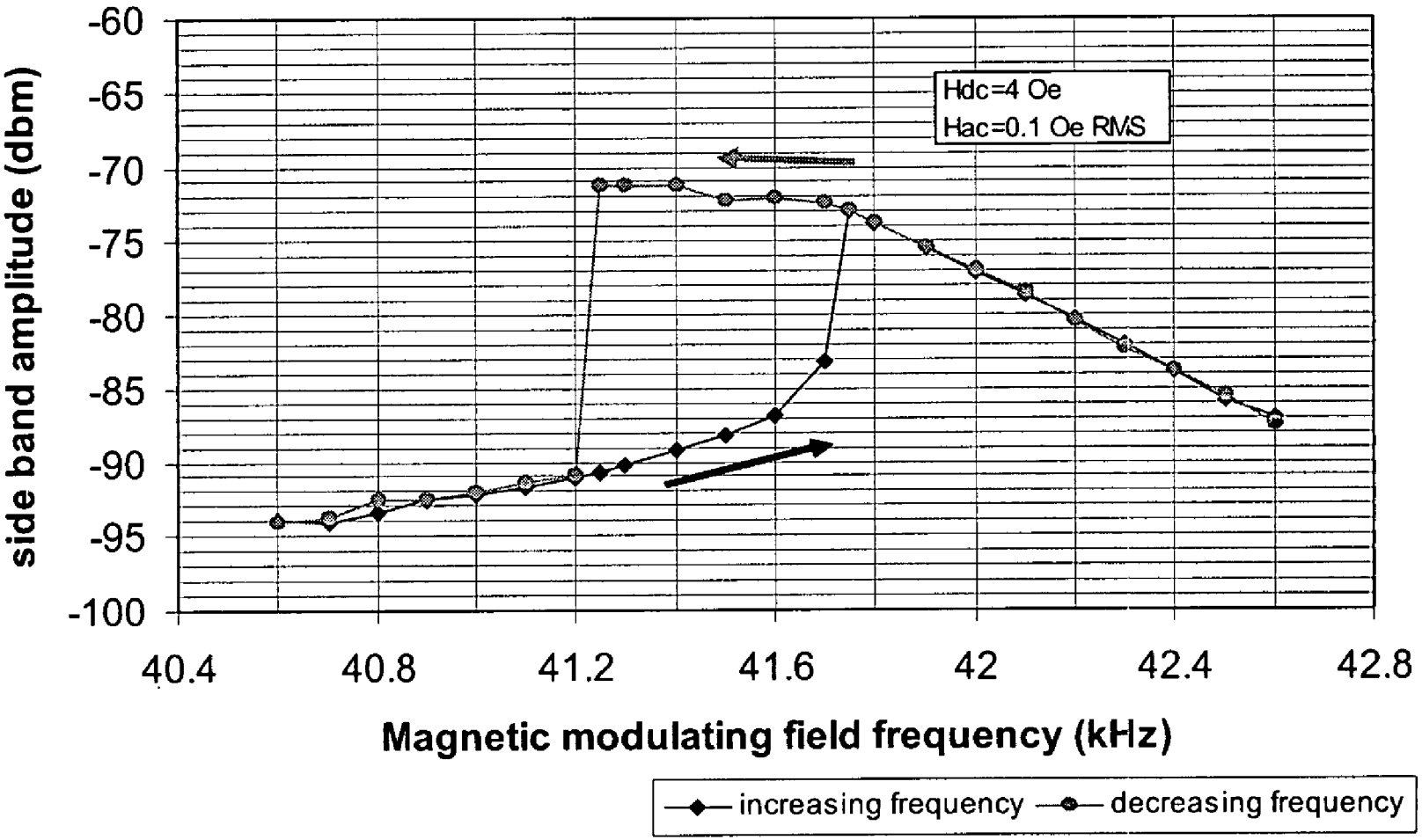
FIG. 7 comprises a graph illustrating sideband amplitude versus magnetic modulating field frequency at 4 Oe in accordance with one embodiment.
Figure 8:
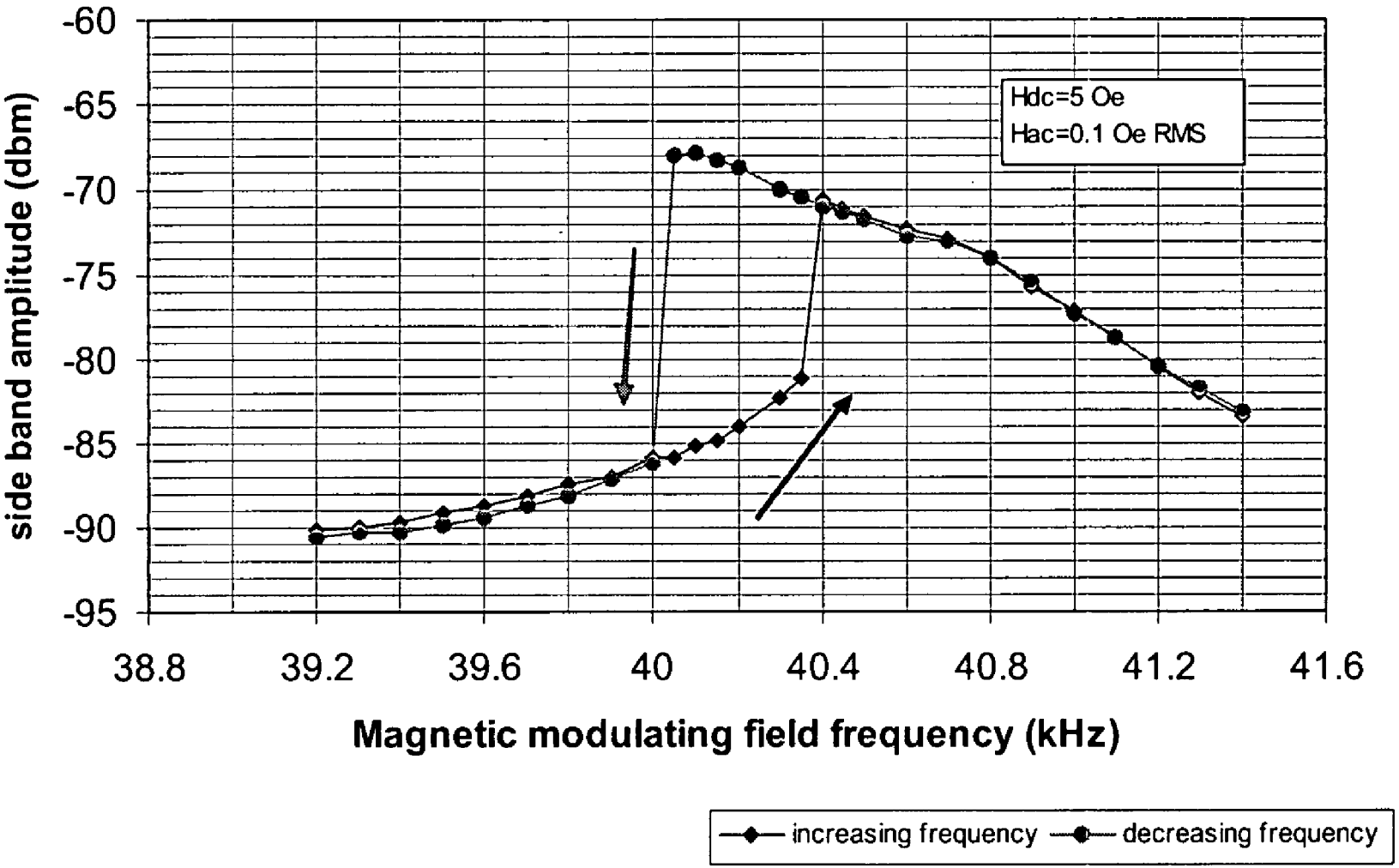
FIG. 8 comprises a graph illustrating sideband amplitude versus magnetic modulating field frequency at 5 Oe in accordance with one embodiment.
Figure 9:
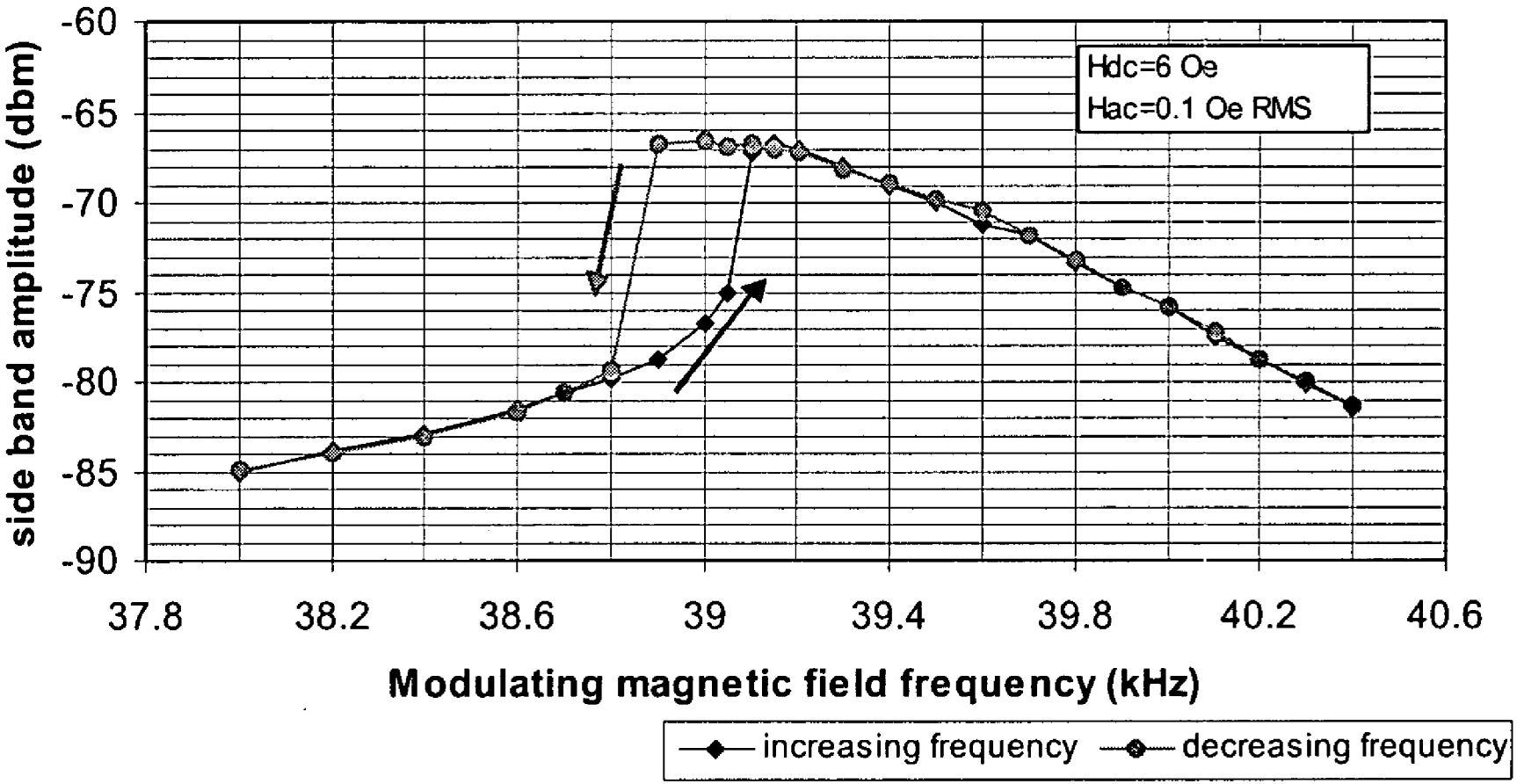
FIG. 9 comprises a graph illustrating sideband amplitude versus magnetic modulating field frequency at 6 Oe in accordance with one embodiment.
Figure 10:
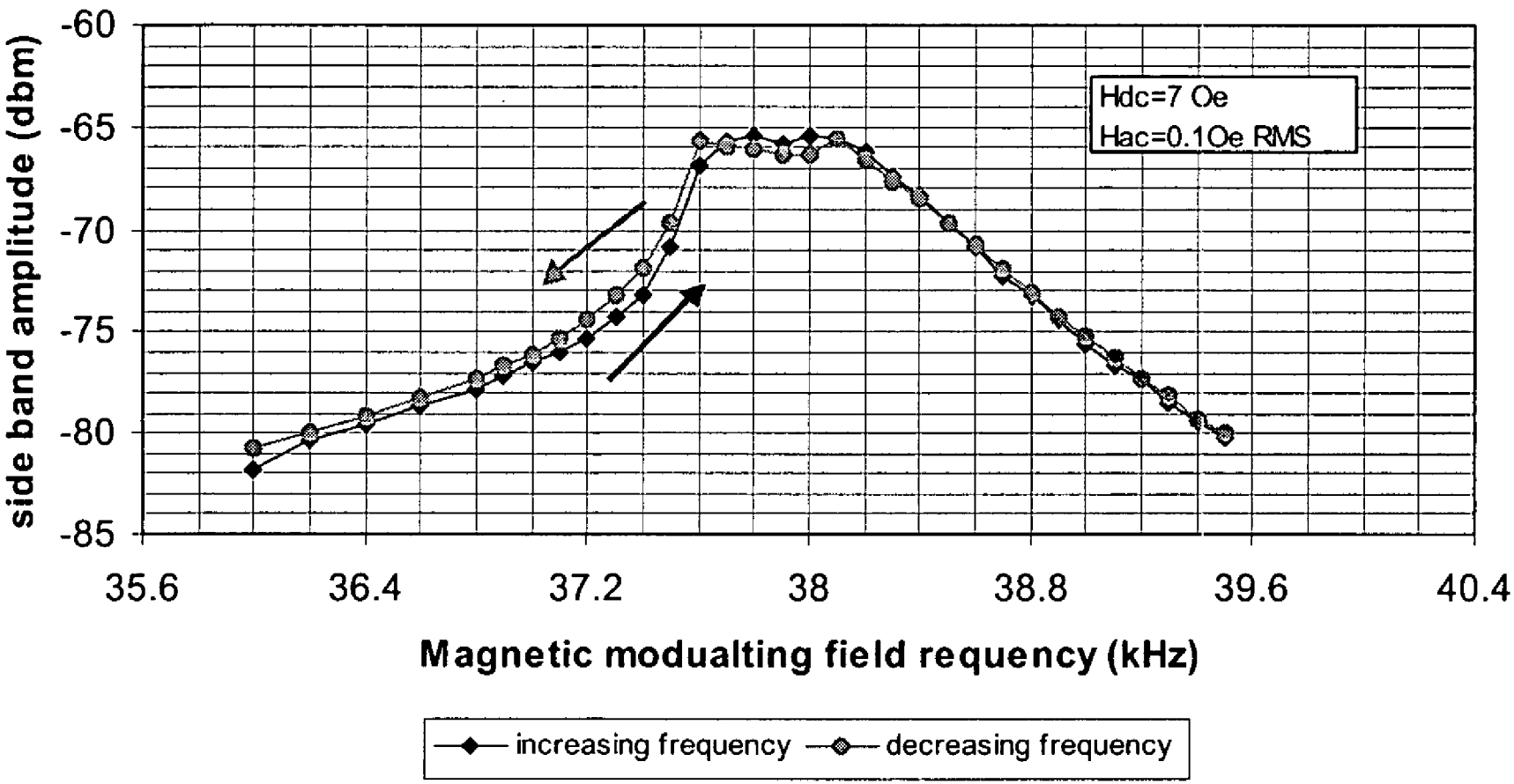
FIG. 10 comprises a graph illustrating sideband amplitude versus magnetic modulating field frequency at 7 Oe in accordance with one embodiment.

FIG. 5 may illustrate the mechanical resonant frequency versus the ring-down amplitude of resonator 202. FIG. 5 illustrates the "ring-down" amplitude of resonator 202 composed using the material in the second example. The ring-down amplitude of this material may be similar to conventional magnetomechanical markers, such as the U*Max resonator at the same operating bias strength of 6–6.5 Oe.

FIGS. 6–10 may illustrate the sideband amplitude versus modulation frequency at different bias points for resonator 202 using the material for the second example. The frequency at peak amplitude is near its mechanical resonant frequency, but there exists a certain amount of offset. The offset may be attributed to sample orientation. The sample was vertical during microwave measurement, and horizontal during the mechanical resonant measurement. The earth field contribution to these two orientations is different. The loading effect may also change its resonant frequency at vertical orientation. The sideband amplitude versus frequency curve when measured as frequency increases does not necessarily match the curve measured as frequency is decreasing. This lagging phenomenon occurs around the resonant frequency and vanishes at high bias. When there is lagging, these curves are not symmetric with the amplitude quickly increasing and gradually decreasing as frequency increases. The trend of maximum sideband amplitude on bias strength is similar to the mechanical ring-down amplitude. It increases and then decreases as the bias increases. The bias point at maximum amplitudes for these two cases, however, does not coincide. As a result of these measurements, it was discovered that the optimum sideband amplitude for this sample is approximately −65 dbm with a noise level of approximately −110 dbm. This may be comparable to the Co-based amorphous wire.

Figure 11:
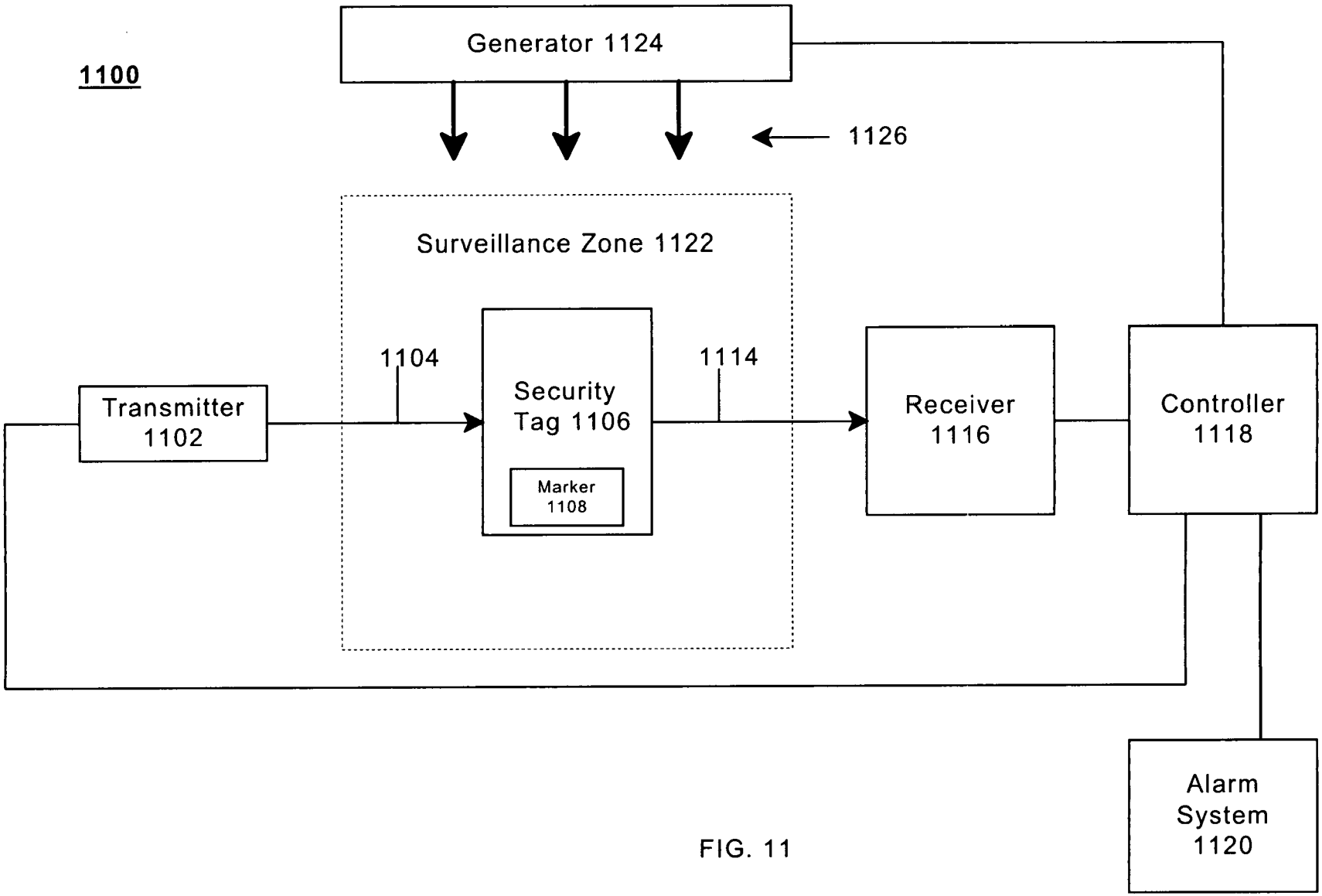
FIG. 11 illustrates a second system in accordance with one embodiment.

FIG. 11 illustrates a second system in accordance with one embodiment. FIG. 11 illustrates a system 1100. System 1100 may be similar to system 100. For example, elements 102, 104, 106, 108, 114, 116, 118, 120, 122, 124 and 126 of system 100 are similar in structure and function as corresponding elements 1102, 1104, 1106, 1108, 1112, 1114, 1116, 1118, 1120, 1124 and 1126 of system 1100, respectively. In system 1100, however, generator 1124 and modulation signal 1126 have been modified relative to generator 124 and modulation signal 126 of system 100. In addition, the configuration of system 1100 obviates the need for a second transmitter, such as transmitter 110 of system 100, as well as second excitation signal 112.

In one embodiment, system 1100 comprises a generator 1124. Generator 1124 may be configured to generate a modulation signal 1126 to cause the reply signal to modulate from marker 1108 to form modulated reply signal 1114. This operation may be similar to generator 124 generating modulation signal 126 to modulate the reply signal from marker 108 of system 100. In system 100, however, modulation signal 126 comprised a relatively low frequency sufficient to modulate the reply signal from the marker 108. In system 1100, generator 1124 has been modified to generate modulation signal 1126 at a higher frequency than generator 124. More particularly, generator 1124 has been modified to generate modulation signal 1126 to a high enough frequency to cause marker 1108 to resonate at its resonant frequency. In this manner, modulation signal 1126 not only modulates the reply signal from marker 1108 to form modulated reply signal 114, but also operates to cause marker 1108 to resonate at the predetermined resonant frequency. In one embodiment, for example, modulation signal 1126 may have an operating frequency of approximately 58 KHz. Since modulation signal 1126 is tuned to cause marker 1108 to resonate, system 1100 obviates the need for a transmitter similar to transmitter 110 to generate second excitation signal 112. The embodiments are not limited in this context.

Portions of the embodiments may be implemented using an architecture that may vary in accordance with any number of factors, such as desired computational rate, power levels, heat tolerances, processing cycle budget, input data rates, output data rates, memory resources, data bus speeds and other performance constraints. For example, one embodiment may be implemented using software executed by a processor. The processor may be a general-purpose or dedicated processor, such as a processor made by Intel® Corporation, for example. The software may comprise computer program code segments, programming logic, instructions or data. The software may be stored on a medium accessible by a machine, computer or other processing system. Examples of acceptable mediums may include computer-readable mediums such as read-only memory (ROM), random-access memory (RAM), Programmable ROM (PROM), Erasable PROM (EPROM), magnetic disk, optical disk, and so forth. In one embodiment, the medium may store programming instructions in a compressed and/or encrypted format, as well as instructions that may have to be compiled or installed by an installer before being executed by the processor. In another example, one embodiment may be implemented as dedicated hardware, such as an Application Specific Integrated Circuit (ASIC), Programmable Logic Device (PLD) or Digital Signal Processor (DSP) and accompanying hardware structures. In yet another example, one embodiment may be implemented by any combination of programmed general-purpose computer components and custom hardware components. The embodiments are not limited in this context.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

What is claimed is:

1. A security tag, comprising:

a marker comprising magnetostrictive material having magnetomechanical and magnetoimpedance properties, said marker configured to generate a modulated reply signal in response to a first excitation signal and a modulation signal, said marker to receive a second excitation signal to cause said marker to resonate at a resonant frequency, with said resonance causing an increase in gain of said modulated reply signal when said magnetostrictive material resonates at said resonant frequency.

2. The security tag of claim 1, wherein said first excitation signal comprises a microwave signal.

3. The security tag of claim 1, wherein said first excitation signal comprises one of a 2.45 GigaHertz microwave signal and 915 MegaHertz microwave signal.

4. The security tag of claim 1, wherein said magnetostrictive material is formed by annealing.

5. The security tag of claim 1, wherein said resonant frequency comprises approximately 58 KiloHertz.

6. The security tag of claim 1, wherein said magnetostrictive material has a composition of at least one of $Fe_{81}B_{13.5}Si_{3.5}C_2$ and $Fe_{40}Co_{40}B_{18}Si_2$.

7. The security tag of claim 1, wherein said magnetostrictive material is annealed at 410 centigrade for 30 seconds in a saturation magnetic field across a width of said material.

8. The security tag of claim 1, wherein said first excitation signal is an electromagnetic first signal within a first frequency range $\Delta f1$, and said modulation signal is a magnetic second signal within a second frequency range $\Delta f2$, where $\Delta f1 >> \Delta f2$, and said modulated reply signal is an electromagnetic third signal composed by said first signal, an amplitude of which is modulated by said second signal.

9. The security tag of claim 1, wherein said first excitation signal is an electromagnetic first signal within a first frequency range $\Delta f1$, and said modulation signal is a magnetic second signal within a second frequency range $\Delta f2$, where $\Delta f1 >> \Delta f2$, and said modulated reply signal is an electromagnetic third signal composed by said first signal, a frequency of which is modulated by said second signal.

10. A system, comprising:

a first transmitter to transmit an excitation signal within a surveillance zone;

a security tag to receive said excitation signal, said security tag comprising a magnetoimpedance marker positioned within said security tag body, said magnetoimpedance marker comprising magnetostrictive material configured to resonate at a resonant frequency, said marker to receive a first excitation signal and modulation signal to generate a modulated reply signal, and a second excitation signal to cause said marker to resonate at said resonant frequency, with said resonance to cause said modulated reply signal to have an increase in gain;

a receiver to receive said modulated reply signal; and a controller to detect said security tag within said surveillance zone and output a detect signal.

11. The system of claim 10, further comprising an alarm system to couple to said controller, said alarm system to receive said detect signal and generate an alarm in response to said detect signal.

12. The system of claim 10, wherein said first excitation signal comprises a microwave signal.

13. The system of claim 10, wherein said first excitation signal comprises one of a 2.45 GigaHertz microwave signal and a 915 MegaHertz microwave signal.

14. The system of claim 10, wherein said magnetostrictive is formed by annealing.

15. The system of claim 10, wherein said resonant frequency comprises approximately 58 KiloHertz.

16. The system of claim 10, wherein said magnetostrictive material has a composition of at least one of $Fe_{81}B_{13.5}Si_{3.5}C_2$ and $Fe_{40}Co_{40}B_{18}Si_2$.

17. The system of claim 10, wherein said magnetostrictive material is annealed at 410 centigrade for 30 seconds in a saturation magnetic field across a width of said material.

18. The system of claim 10, wherein said first excitation signal is an electromagnetic first signal within a first frequency range $\Delta f1$, and said modulation signal is a magnetic second signal within a second frequency range $\Delta f2$, where $\Delta f1 >> \Delta f2$, and said modulated reply signal is an electromagnetic third signal composed by said first signal, an amplitude of which is modulated by said second signal.

19. The system of claim 10, wherein said first excitation signal is an electromagnetic first signal within a first frequency range $\Delta f1$, and said modulation signal is a magnetic second signal within a second frequency range $\Delta f2$, where $\Delta f1 >> \Delta f2$, and said modulated reply signal is an electromagnetic third signal composed by said first signal, a frequency of which is modulated by said second signal.

20. A method, comprising:

receiving a first excitation signal at a marker;

generating a reply signal in response to said first excitation signal;

receiving a modulation signal at said marker;

modulating said reply signal in response to said modulation signal to form a modulated reply signal; and receiving a second excitation signal at said marker, said second excitation signal to cause said marker to resonate at a resonant frequency, with said resonance causing an increase in gain of said modulated reply signal.

21. The method of claim 20, wherein said first excitation signal has a higher frequency than said second excitation signal.

22. The method of claim 20, wherein said first excitation signal is a microwave signal.

23. A security tag, comprising:

a marker comprising magnetostrictive material having magnetomechanical and magnetoimpedance properties, said marker configured to generate a modulated reply signal in response to an excitation signal and a modulation signal, said modulation signal to cause said marker to resonate at a resonant frequency, with said resonance causing an increase in gain of said modulated reply signal when said magnetostrictive material resonates at said resonant frequency.

24. The security tag of claim 23, wherein said excitation signal comprises a microwave signal.

25. The security tag of claim 23, wherein said excitation signal comprises one of a 2.45 GigaHertz microwave signal and 915 MegaHertz microwave signal.

26. The security tag of claim 23, wherein said resonant frequency comprises approximately 58 KiloHertz.

* * * * *